United States Patent [19]

Huggins et al.

[11] Patent Number: 4,958,830

[45] Date of Patent: Sep. 25, 1990

[54] EXERCISE APPARATUS

[76] Inventors: Jack D. Huggins, 212 Country Club Cir.; John Pannel, 11508 Surrey La., both of Midwest City, Okla. 73110

[21] Appl. No.: 276,014

[22] Filed: Nov. 25, 1988

[51] Int. Cl.[5] ..... A63B 22/12

[52] U.S. Cl. ..... 272/69; 272/70; 128/25 R

[58] Field of Search ..... 272/69, 70, 73, 121; 128/25 R

[56] References Cited

U.S. PATENT DOCUMENTS

| | | | |
|---|---|---|---|
| 2,079,594 | 5/1937 | Clem | 128/25 R |
| 2,093,830 | 9/1937 | Flatley | 128/25 R |
| 2,696,206 | 12/1954 | Bierman | 128/25 R |
| 2,924,214 | 2/1960 | Zak | 128/25 R |
| 3,316,898 | 5/1967 | Brown | 128/25 R |
| 3,381,958 | 5/1968 | Gulland | 272/73 |
| 4,720,093 | 1/1988 | Del Mar | 128/25 R X |

OTHER PUBLICATIONS

Versa Climber by Heart Rate Inc., 3001 Redhill Ave., Suite 106, Costa Mesa, Calif. 92626, (714) 850-9716, 11/1987.

*Primary Examiner*—Richard J. Apley
*Assistant Examiner*—H. N. Flaxman
*Attorney, Agent, or Firm*—Dunlap, Codding, Peterson & Lee

[57] ABSTRACT

A mechanically powered exercise apparatus is provided having a pair of slidable accommodated vertical bars supported in an elongated housing. Each bar has an extending hand grip, and a foot support secured at opposite end thereof. In operation, the bars are reciprocated in opposite directions within the housing for simulating a climbing motion.

4 Claims, 4 Drawing Sheets

EXERCISE APPARATUS

FIELD AND BACKGROUND OF INVENTION FOR EXERCISE APPARATUS

1. Field of Invention.

The present invention relates generally to powered exercise machines.

2. Background of Invention.

Recently, the general public has become increasingly aware of the health benefits derived by the incorporation of an aerobic exercise program in one's daily activities. In some instances, the incident rate of skeletal muscular injuries has kept pace with the growing level of participation by the general public in these types of exercise programs. In an effort to reduce the incident rate of skeletal muscular injuries, it has been suggested that individuals engaging in daily exercise programs avoid high impact workouts.

The apparatus of this invention eliminates many of the injury causing impact problems associated with traditional forms of aerobic exercise. The smooth climbing motion, created by the oppositely reciprocating arm and foot supports, provides an aerobic workout free of injury causing impact.

DETAILED DESCRIPTION OF THE DRAWINGS

Figure 1:
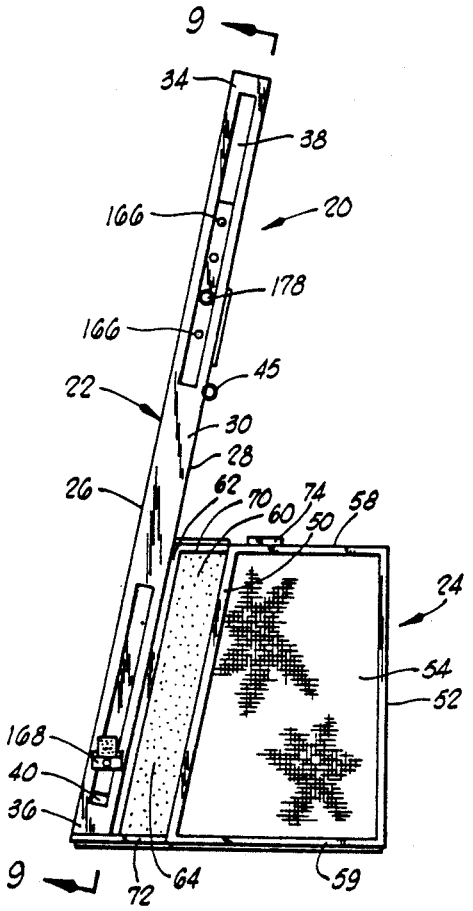
FIG. 1 is a side elevational view of an exercise apparatus constructed in accordance with the invention.
Figure 2:
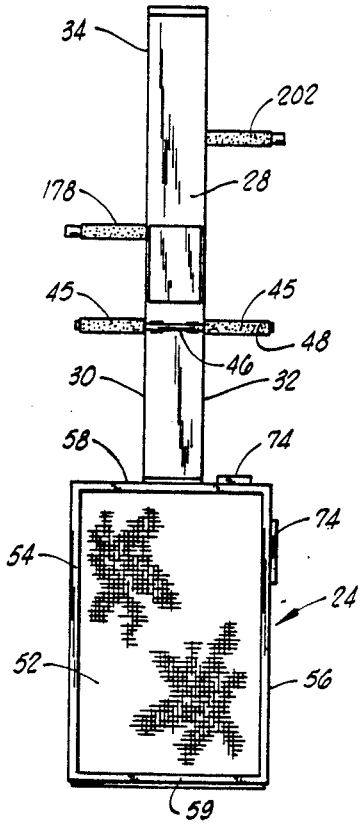
FIG. 2 is a rear elevational view of the exercise apparatus shown in FIG. 1.
Figure 3:
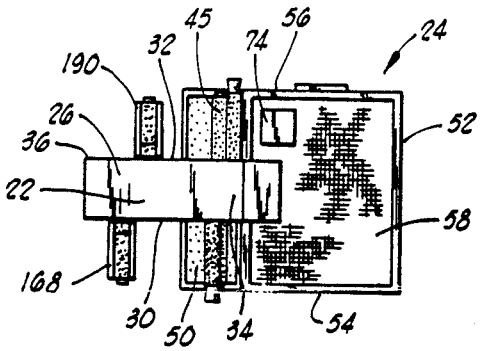
FIG. 3 is a top plan view of the exercise apparatus shown in FIG. 1.
Figure 4:
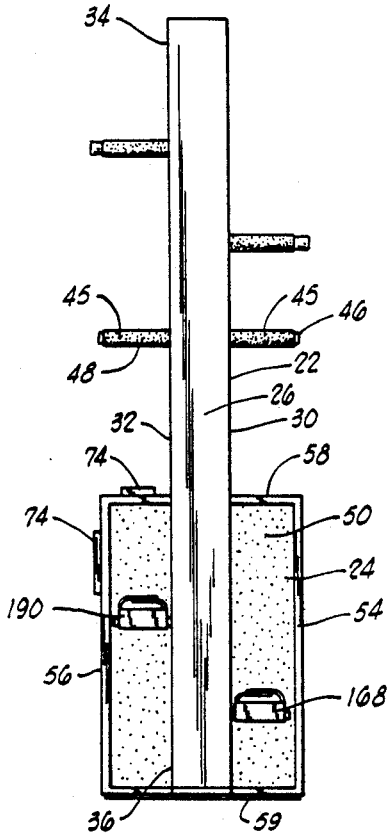
FIG. 4 is a front elevational view of the exercise apparatus shown in FIG. 1.

Referring to the drawings in detail, and particularly to FIGS. 1 through 5 and 13, the present invention comprises an exercise apparatus designated generally by the reference numeral 20. The exercise apparatus 20 includes an elongated housing 22 supported in a generally vertical position by a support housing 24.

The elongated housing 22 includes a front side 26, a rear side 28, a first side 30, a second side 32, an upper end portion 34, and a lower end portion 36. The elongated housing 22 further includes a first upper slot 38 located along the upper portion 34 of the first side 30 and a first lower slot 40 located along the lower portion 36 of the first side. The elongated housing 22 also includes a second upper slot 42 (FIG. 5) located along the upper portion 34 of the second side 32 and a second lower slot 44 located along the lower portion 36 of the second side 32.

A pair of stationary hand grips 45 are provided on the elongated housing 22 to facilitate the mounting and dismounting of the exercise apparatus 20. The hand grips 45 include a horizontal bar 46 secured to the rear side 28 of the elongated housing 22 above the first and second lower slots 40 and 44. A padded sleeve 48 overlies portions of the horizontal bar 46 extending beyond the first side 30 and the second side 32 of the elongated housing 22.

The support housing 24 includes a front side 50, a rear side 52, a first side 54, a second side 56, a top side 58 and a bottom side 59. A housing extension 60 is secured to the front side 50 of the support housing 24. The housing extension 60 includes a front housing extension side 62, a first housing extension side 64, a second housing extension side 66, a rear housing extension side (not shown), a top housing extension side 70 and a bottom housing extension side 72.

Figure 5:
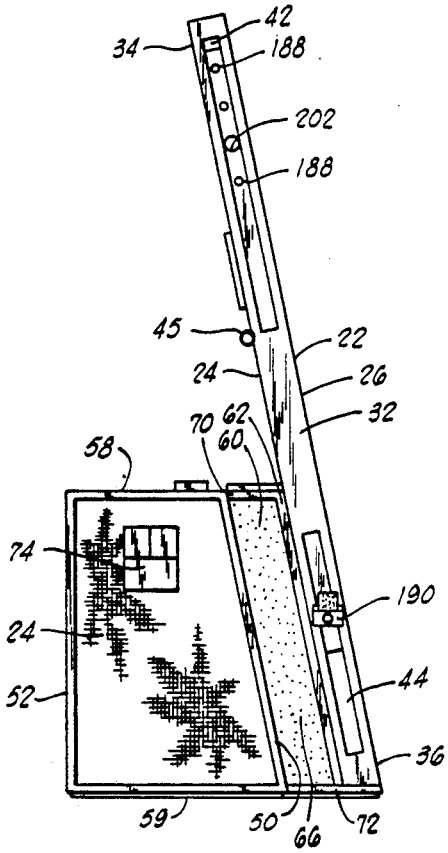
FIG. 5 is a side elevational view of the exercise apparatus shown in FIG. 1.

As shown in FIGS. 1 and 5, the front side 50 and the front housing extension side 62 are in parallel alignment and positioned generally vertically. In this way, the elongated housing 22, secured to the front housing extension side 62, is supported generally vertically. The exercise apparatus 20 also includes several display and control panels, designated by reference numeral 74 for controlling and monitoring activities such as the pace and duration of the workout, the users heart rate and other physiological activities.

Figure 6:
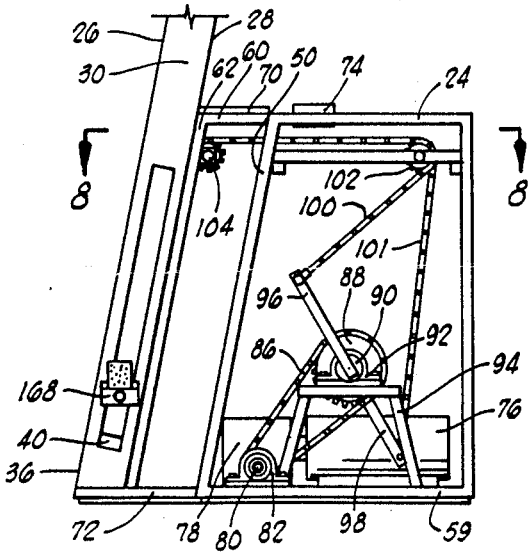
FIG. 6 is an enlarged fragmented side elevational view of the exercise apparatus with a side panel removed.
Figure 7:
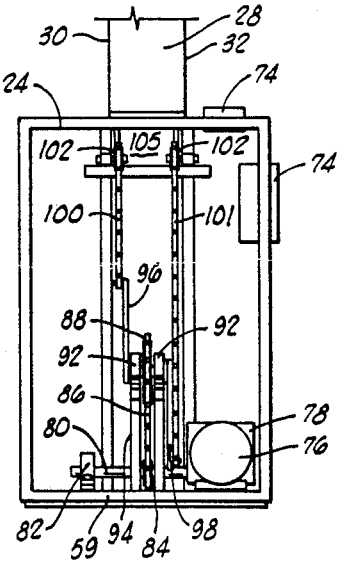
FIG. 7 is an enlarged fragmented rear elevational view of the exercise apparatus shown in FIG. 6 with a rear panel removed.

Referring now to FIGS. 6 and 7, the support housing 24 encloses an electric motor 76, such as a Lesson #108014 manufactured by Lesson Electric Corporation, Grafton, Wis., secured to the bottom side 59. A reducer 78, such as a Grant #STF225, 50 to 1, AM1 manufactured by Grant Gear Inc. Norwood Mass., having an input shaft (not shown), and an output shaft (not shown) is also enclosed within the support housing 24 and secured to the bottom side 59 adjacent the electric motor 76 such that the input shaft of the reducer (FIG. 8) is coupled to the electric motor 76. A drive shaft 80, coupled at one end to the output shaft of the reducer (FIG. 8), is rotatably mounted in a drive bearing 82 secured to the bottom side 59 of the support housing 24.

A drive sprocket 84 is secured to the drive shaft 80 between the drive bearing 82 and the reducer 78. A continuous roller chain 86 connects the drive sprocket 84 with a crank sprocket 88, the crank sprocket 88 being secured to a crank shaft 90. The crank shaft 90 is rotatably mounted within by a pair of side-by-side crank shaft bearings 92, the crank shaft bearings 92 being secured to a support from 94. The support frame 94 is secured to the bottom side 59 of the support housing 24.

A first arm 96 is secured to one end of the crank shaft 90 and extends therefrom at a right angle. A second arm 98, positioned 180° off the first arm 96, is secured to the opposite end of the crank shaft 90 and extends therefrom at a right angle. A first chain 100 is pivotally secured to the extending end of the first arm 96 and a second chain 101 is secured to the extending end of the second arm 98.

The first and second chains, 100 and 101, are threaded over a first pair of side-by-side guide sprockets 102 respectively. The first pair of side-by-side guide sprockets 102 is secured to the support housing 24 above the crank sprocket 78. The first and second chains, 100 and 101 are further threaded over a second pair of side-by-side guide sprockets 104. The sprocket pair 104 is horizontally aligned with the sprocket pair 102 and secured to the support housing extension 60. From the sprocket pair 104, the first and second chains 100 and 101 extend downwardly into the elongated housing 22 through an aperture 105 in the rear side 28.

Figure 8:
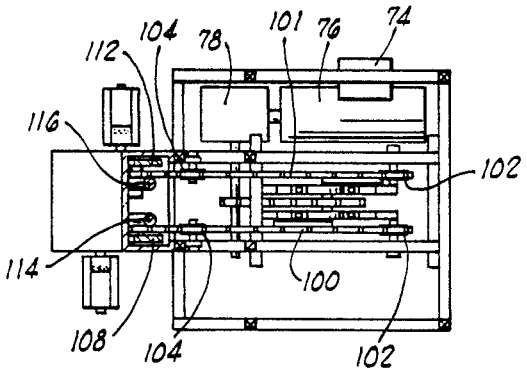
FIG. 8 is a cross-sectional view taken along line 8—8 of FIG. 6.
Figure 9:
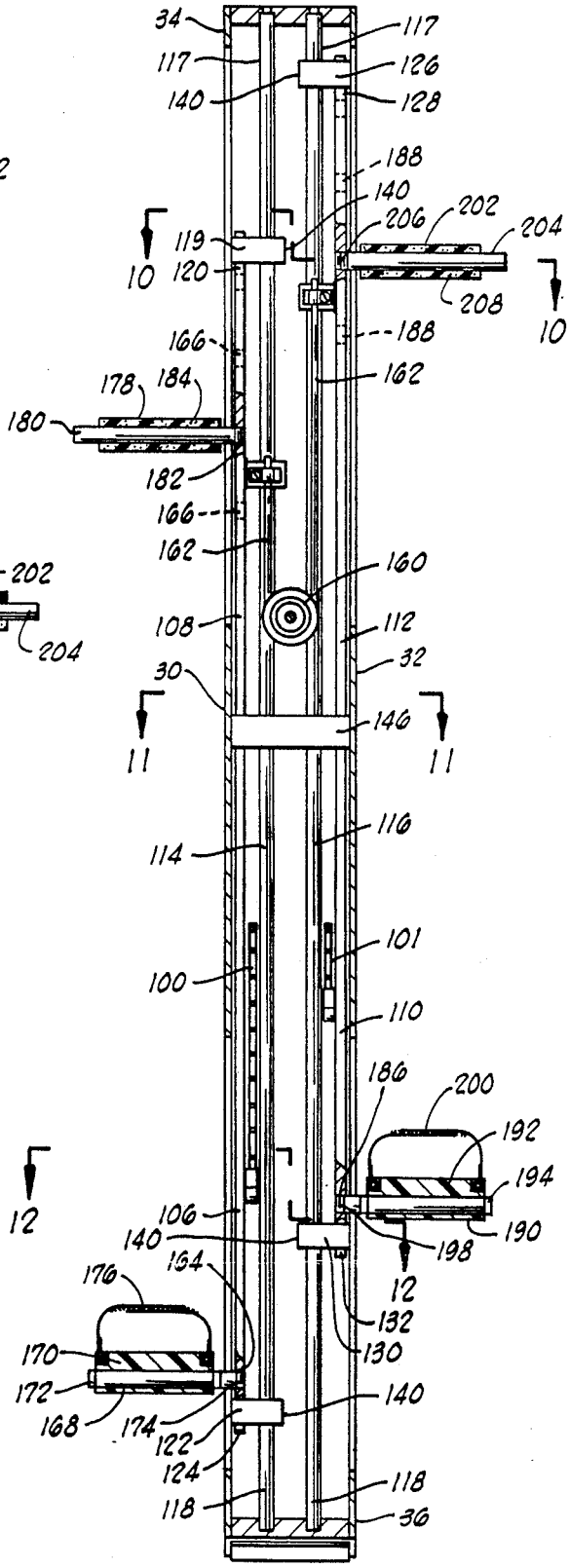
FIG. 9 is a cross-sectional view taken along line 9—9 of FIG. 1.
Figure 13:
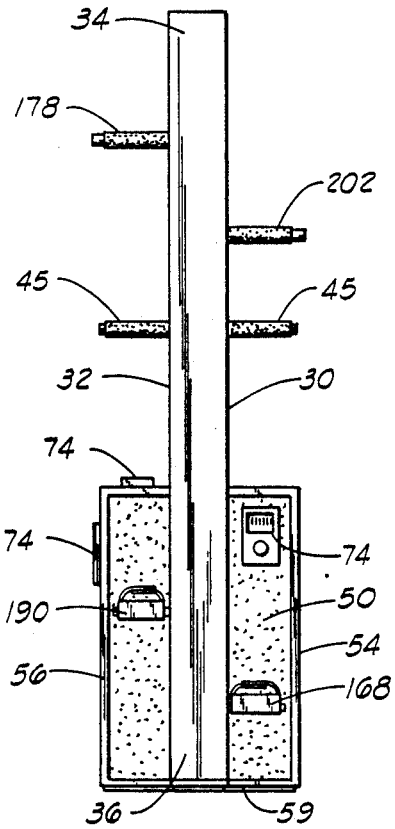
FIG. 13 is a front elevational view of a the exercise apparatus.

Referring now to FIGS. 8 and 9, the free ends of the first and second roller chains, 100 and 101, extending into the elongated housing 22 are secured to a lower portion 106 of a first bar 108 and a lower portion 110 of a second bar 112 respectively. The first bar 108 and the second bar 112 are slidably supported in side-by-side relationship within the elongated housing 22 in a manner to be discussed below, for movement along the length thereof.

The elongated housing 22 further includes a first rod 114 and a second rod 116 secured within and extending substantially the length of the elongated housing 22. Each rod 114 and 116 has an upper end 117 and a lower end 118 secured to the upper portion 34 and the lower portion 36 of the elongated housing 22 respectively, such that the rods 116 and 118 are in a side-by-side relationship between the first bar 108 and the second bar 112.

The first bar 108 is slidably mounted to the first rod 114 by an upper guide block 119 secured to an upper portion 120 of the first bar 108 and a lower guide block 122 secured to a lower portion 124 of the first bar 108. The second bar 112 is slidably mounted to the second rod 116 by an upper guide block 126 secured to an upper portion 128 of the second bar 112 and a lower guide block 130 secured to a lower portion 132 of the second bar 112.

Figure 10:
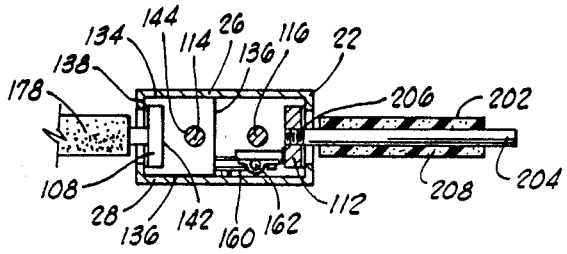
FIG. 10 is a cross-sectional view taken along line 10—10 of FIG. 9.
Figure 12:
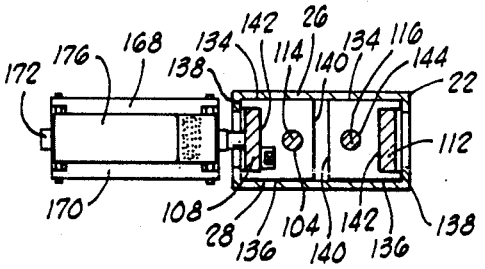
FIG. 12 is a cross-sectional view taken along line 12—12 of FIG. 9.

Referring now to FIGS. 9,10 and 12, each of the guide blocks 119, 122, 126, and 130 are identical and are formed from a sheet of ultra high molecular weight (UHMW) polyethylene distributed by Cope Plastic Inc., Oklahoma City, Okla. Each guide block is substantially rectangular having a front side 134, a rear side 136, a first side 138 and a second side 140. The first side 138 includes a flat-sided U-shaped channel 142, sized for closely receiving one of the bars along the width thereof. Each guide block further includes a vertical aperture 144 sized for closely receiving one of the rods. Each guide block is sized such that the front and the rear sides, 134 and 136, are in close clearance With the front and rear sides, 26 and 28, of the elongated housing 22. In this way, the bars 108 and 112 are retained in parallel alignment with the first and second sides, 30 and 32, respectively as the bars 108 and 112 are slidably reciprocated within the elongated housing 22.

Figure 11:
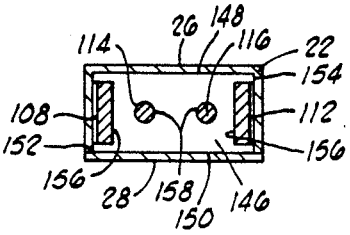
FIG. 11 is a cross-sectional view taken along line 11—11 of FIG. 9.

Turning now to FIGS. 9 and 11, the elongated housing 22 also includes a center guide block 146, formed from a sheet of UHMW. The center guide block 146 is centrally position within the elongated housing 22 and secured thereto. The center guide block 146 is substantially rectangular having a front side 148, a rear side 150, a first side 152 and a second side 154. The center guide block 146 is sized such that the front and rear sides 148 and 150 are in close clearance with the front and rear sides 26 and 28 of the elongated housing 22. Both the first side 152 and the second side 154 include a pair of oppositely facing flat-sided, U-shaped channels 156. Each channel 156 is sized for closely receiving one of the bars. The center guide block 146 also includes and a pair of side-by-side apertures 158. Each aperture is sized for closely receiving one of the rods. In this way, the center guide block 146 provides vertical support for the rods and the bars within the elongated housing 22.

Referring to FIGS. 9 and 10, the elongated housing 22 further includes a pulley 160 secured to the rear side 28 and an elastic belt 162 having one end thereof secured to the upper portion 128 of the first bar 108 and the other end secured to the upper portion 120 of the second bar 112. The elastic belt 162 is sized such that a downward force of sufficient strength, for a purpose to be discussed below, is exerted on each bar upon threading the elastic belt 162 around the pulley 160.

Turning now to FIGS. 1, 9 and 12, the lower portion 124 of the first bar 108 includes a threaded aperture 164, aligned with the first lower slot 40. The upper portion 120 of the first bar 108 includes a vertical row of threaded apertures 166, aligned with the first upper slot 38.

The exercise apparatus 20 further includes a first bar foot support 168 having a foot plate 170 and a shaft 172 secured to the foot plate 170. A threaded end 174 of the shaft 172 is threaded into the aperture 164 for securing the first bar foot support 168 to the lower portion 124 of the first bar 108. The first bar foot support 168 is provided with an adjustable foot strap 176.

Secured to the upper portion 120 of the first bar 108 through one of the threaded apertures 166 is a first bar hand grip 178. The first bar hand grip 178 includes a shaft 180 having a threaded end 182 sized for engaging the apertures 166. An overlying padded sleeve 184 is secured to the shaft 180.

Referring to FIGS. 5 & 9, the lower portion 132 of the second bar 112 includes a threaded aperture 186 aligned with the second lower slot 44. The upper portion 128 of the second bar 112 includes a vertical row of threaded apertures 188 aligned with the second upper slot 42.

With continued reference to FIG. 5 & 9, the exercise apparatus 20 further includes a second bar foot support 190 having a foot plate 192 and a shaft 194 secured to the foot plate 192. A threaded end 198 of shaft 194 is threaded into aperture 186 for securing the second bar foot support 190 to the lower portion 132 of the second bar 112. The second bar foot support 190 also includes an adjustable footstrap 200.

Secured to the upper portion 128 of the second bar 112 through one of the threaded apertures 188 is a second bar hand grip 202. The second bar hand grip 202 includes a shaft 204 having a threaded end 206 sized for engaging the apertures 188. An overlying padded sleeve 208 is secured to the shaft 204.

In operation, the first bar 108 and the second bar 112 are reciprocated in opposite directions along the length of the elongated housing 22 by a wind mill motion of the first arm 96 and the second arm 98. The wind mill motion of the first and second arms, 96 and 98, alternately extend and retract the first and second roller chains, 100 and 101, within the elongated housing 22, thereby alternately raising and lowering each bar.

The downward stroke of each bar 108 and 112, is gravity induced and not mechanically powered by the electric motor 76. It will now be appreciated that the force exerted by the elastic belt 150 on the bars 108 and 112 creates a tension force on the roller chains 100 and 101 for preventing slack from occurring in the chains and to insure the smooth downward motion of each bar.

Figure 14:
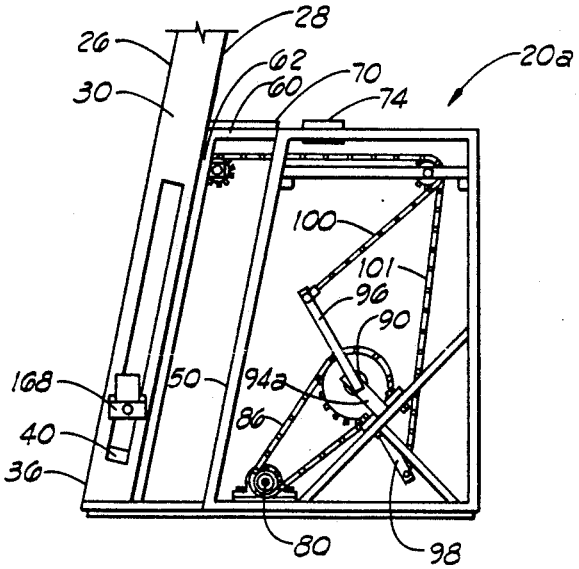
FIG. 14 is a side elevational view of a modified exercise apparatus with a side panel removed.
Figure 15:
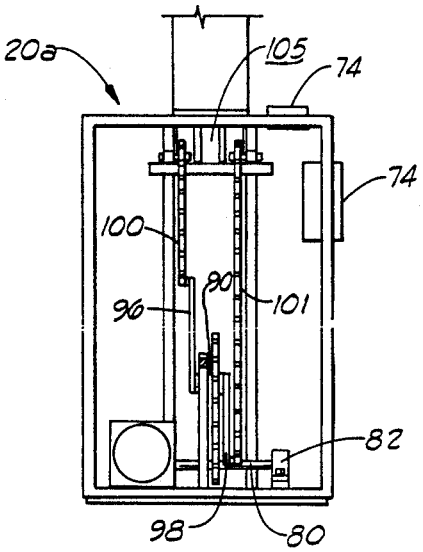
FIG. 15 is a rear elevational view of the exercise apparatus shown in FIG. 14 with a rear panel removed.

A modified exercise apparatus 20*a* is illustrated in FIGS. 14 and 15. The exercise apparatus 20*a* is constructed exactly like the exercise apparatus 20 described in detail before except that the crank shaft 90 is rotatably mounted within a single crank shaft bearing (not shown) secured within the support frame 94*a*.

Changes may be made in the combinations, operations, and arrangement of the various parts and elements described herein without departing from the spirit and scope of the invention as defined in the following claims.

We claim:

1. An exercise apparatus comprising:

an elongated housing;

means for supporting the elongated housing generally vertically;

at least one elongated bar;

means for slidably supporting the bar movement along the length of the elongated housing;

a foot support secured to the bar; and means for moving the bar along the length of the elongated housing;

wherein the means for moving one of the bars comprises:

a chain having one end secured to a lower portion of the bar;

a horizontal shaft rotatably mounted on a support;

a sprocket secured to the horizontal shaft;

an arm, having one end extending radially from the horizontal shaft and secured thereto, wherein the other end of the chain is secured to a portion of the arm extending beyond the horizontal shaft; and means for rotating the sprocket.

2. An exercise apparatus comprising:

an elongated housing;

means for supporting the elongated housing generally vertically;

at least one elongated bar;

means for slidably supporting the bar for movement along the length of the elongated housing;

a hand grip secured to the bar; and means for moving one of the bars along the length of the elongated housing, wherein the means for moving one of the bars comprises:

a chain having one end secured to a lower portion of the bar;

a horizontal shaft rotatably mounted on a support;

a sprocket secured to the horizontal shaft;

an arm, having one end extending radially from the horizontal shaft and secured thereto, wherein the other end of the chain is secured to a portion of the arm extending beyond the horizontal shaft; and means for rotation of the sprocket.

3. An exercise apparatus comprising:

an elongated housing;

means for supporting the elongated housing generally vertically;

a pair of elongated bars;

means slidably supporting the bars in side-by-side relation for movement along the length of the elongated housing;

a foot support secured to the lower end portion of each bar;

a hand grip secured to the upper portion of each bar; and means for reciprocating the bars in opposite directions along the elongated housing, wherein the means for oppositely reciprocating the first and the second bars comprises:

a first chain having one end secured to a lower portion of the first bar;

a second chain having one end secured to a lower portion of the second bar;

a horizontal shaft rotatably mounted on a support;

a sprocket secured to the horizontal shaft;

a first arm having one end extending radially from the horizontal shaft and secured thereto, wherein the other end of the chain is secured to a portion of the first arm extending beyond the horizontal shaft;

a second arm, positioned 180° off the first arm, having one end extending radially from the horizontal shaft and secured thereto, wherein the other end of the second chain is secured to a portion of the second arm extending beyond the horizontal shaft; and means for rotating the sprocket.

4. An exercise apparatus comprising:

a support housing;

an elongated housing supported generally vertically and secured to the support housing, wherein the elongated housing has a front side, a rear side, a first side, and a second side, and wherein an upper portion of the elongated housing at the first side has a first upper slot, and wherein a lower portion of the elongated housing at the first side has a first lower slot, and wherein an upper portion of the elongated housing at the second side has a second upper slot, and wherein a lower portion of the elongated housing at the second side has a second lower slot;

a first bar and a second bar, each bar slidably secured within the elongated housing, wherein the first bar is positioned adjacent the first side of the elongated housing and the second bar is positioned adjacent the second side of the elongated housing, and wherein the first bar has a first bar foot support secured to a lower portion thereof, the first bar foot support extending through the first lower slot and beyond the elongated housing, and wherein the first bar has a first bar hand grip secured to an upper portion thereof, the first bar hand grip extending through the first upper slot and beyond the elongated housing, and wherein the second bar has a second bar foot support secured to a lower portion thereof, the second bar foot support extending through the second lower slot and beyond the elongated housing, and wherein the second bar has a second bar hand grip secured to an upper portion thereof, the second bar hand grip extending through the second upper slot and beyond the elongated housing; and means for oppositely reciprocating the first and second bars within the elongated housing;

wherein the means for oppositely reciprocating the first and the second bars comprises:

a first chain having one end secured to a lower portion of the first bar;

a second chain having one end secured to a lower portion of the second bar;

a horizontal shaft rotatably mounted on a support;

a sprocket secured to one end of the horizontal shaft;

a first arm, having one end extending radially from the horizontal shaft and secured thereto, wherein the other end of the first chain is secured to a portion of the first arm extending beyond the horizontal shaft;

a second arm, positioned 180° off the first arm, having one end extending radially from the horizontal shaft and secured thereto, wherein the other end of the second chain is secured to a portion of the second arm extending beyond the horizontal shaft; and means for rotating the sprocket.

* * * * *